United States Patent [19]

Gruner

[11] Patent Number: 4,898,785

[45] Date of Patent: Feb. 6, 1990

[54] $CR_2O_3$-PROTECTIVE COATING AND PROCESS FOR ITS MANUFACTURE

[75] Inventor: Heiko Gruner, Beinwil am See, Switzerland

[73] Assignee: Plasmainvent AG, Zug, Switzerland

[21] Appl. No.: 356,615

[22] Filed: May 22, 1989

Related U.S. Application Data

[63] Continuation of Ser. No. 942,843, filed as PCT EP86/00226 on Apr. 17, 1986, published as WO86/06103 on Oct. 23, 1986, abandoned.

[30] Foreign Application Priority Data

Apr. 17, 1985 [DE] Fed. Rep. of Germany ..... 3513892

[51] Int. Cl.[4] ..... B05D 1/08

[52] U.S. Cl. ..... 428/472; 428/702; 427/34

[58] Field of Search ..... 427/34, 423; 428/702, 428/472

[56] References Cited

U.S. PATENT DOCUMENTS

| | | | |
|---|---|---|---|
| 2,964,420 | 12/1960 | Poorman et al. | 117/21 |
| 3,640,757 | 2/1972 | Grubba | 117/93.1 PF |
| 3,839,618 | 10/1974 | Muehlberger | 427/34 |
| 4,006,340 | 2/1977 | Gorinas | 427/34 X |
| 4,313,975 | 2/1982 | Mairy | 427/34 X |
| 4,370,391 | 1/1983 | Mori et al. | 428/702 X |
| 4,396,661 | 8/1983 | George et al. | 427/34 X |
| 4,577,431 | 3/1986 | Siemers | 427/34 |
| 4,596,718 | 6/1986 | Gruner | 427/34 |

FOREIGN PATENT DOCUMENTS

| | | |
|---|---|---|
| 2117731 | 7/1972 | France . |
| 2357656 | 6/1977 | France . |
| 589149 | 6/1977 | Switzerland . |

OTHER PUBLICATIONS

Coating for High Temperature Applications, Lang, 1983, ELSEVIER Science Pub. Co., Inc., New York, N.Y., pp. 128–135.

*Primary Examiner*—Shrive Beck

*Attorney, Agent, or Firm*—Webb, Burden, Ziesenheim & Webb

[57] ABSTRACT

The $Cr_2O_3$ protective coating (3) is applied, during the vacuum spray process, as a leakproof coating to a support (1), and has a density of not more than 5.3 g/cm$^3$, a residual porosity of less than 2%, a Vickers hardness (HV) of over 2000 kp/mmm$^2$ and an electric strength of at least 5 V/μm of protective thickness; it is particularly suited as a protective coating on supports (3) exposed to corrosion and simultaneously subjected to high mechanical loads.

8 Claims, 1 Drawing Sheet

$CR_2O_3$-PROTECTIVE COATING AND PROCESS FOR ITS MANUFACTURE

Figure 1:
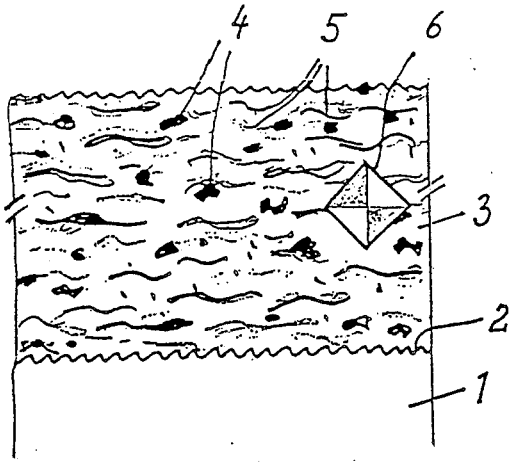

This is a continuation of co-pending application Ser. No. 06/942,843 filed as PCT EP86/00226 on Apr. 17, 1986, published as WO86/06103 on Oct. 23, 1986, now abandoned.

The invention relates to a $Cr_2O_3$ protective coating applied to a support by the vacuum spray process and a process for its manufacture. Such protective coatings can be applied to very different support substances and are deposited for various reasons onto the surfaces of work pieces, normally with the view to increase the working life of the support substance in a particular application with the help of the special material properties of the chromium oxide and/or to open up new ranges of application for the base material.

Due to the high energy density in the plasma flame, the plasma spray process is very suitable to melt an oxides and therefore typically powder particles with a high melting point, and to deposit them as a spray coating on a surface of the workpiece. In very many applications the $Cr_2O_3$ protective layer so produced is not thick enough, the adhesion to the surface of the workpiece and the cohesion of the individual spray powder particles to each other is not adequate. The specific physical properties of $Cr_2O_3$ also produce in the chromium oxide-plasma spray layer additional changes: because chromium oxide is only a stable chemical compound well below its melting temperature it decomposes partly during the melting in the plasma flame, and oxygen is liberated.

Although, during the plasma spraying process, oxygen from the air can defuse continuously into the plasma flame, its concentration is not sufficient to prevent the part decomposition of $Cr_2O_3$ into metallic chromium and oxygen. This process is reinforced additionally by the use of hydrogen along side argon as the plasma gas to generate sufficient plasma flame energy and heat content. In this way the chromium oxide particles are melted in a reducing atmosphere, which favors the speed of decomposition. As a result more or less strongly defined regions of metallic chromium are found in a $Cr_2$ protective layer which reduce the hardness of the layer considerably compared with the values for chromium oxide in the solid state. It is stated here explicitly that this layer structure can be very advantageous in particular applications. On the other hand, it is not possible to produce very pure $Cr_2O_3$ protective layers due to the aforementioned physical effects. Further, because chromium oxide layers are employed as a protective layer on substances which are subject to corrosion and wear, particularly because of the chemical resistance of the pure $Cr_2O_3$, the protective effect is really seriously endangered because of the imbedded metallic phases not only in the reduction of the hardness of the layer but also in the reduction of the corrosion resistance. Additionally, the electrical breakdown strength of the pure $Cr_2O_3$ layer which is usually a good insulator, is markedly reduced because of the metal impurities.

Concerning the sprayed layer density, two effects which may occur should be explained:

a. The volume effect: If the sprayed layer is porous then the density of the layer is lower than the value for a solid compound.

b. The effect of the chemical composition of the layer: If a partial reduction occurs in a oxidized sprayed layer the density alters in the direction of the value for that of the metallic component. Thus, for $Cr_2O_3$, the density increases towards the value for $Cr_2O_3 = 7.2$ g/cm$^3$.

Here are, therefore, two contradictory effects. The reduction in the porosity increases the density of a $Cr_2O_3$ protective layer, while prevention of the inclusion of metallic phases reduces the density (specific weight).

The vacuum spray process (VSP method) in which the spraying process is carried out in a vacuum results in considerable improvements in the condition of the coating and in the coating properties in comparison with the spray process in air (ASP). The beam speed in a vacuum is two to three times higher. Correspondingly, the spray powder particles are also faster and denser spray coatings with reduced residual porosity are produced. Further, the transferred electric arc helps to free the surface of the support from gas contamination, moisture and thin oxide films before the coating process. This results in a distinct improvement in the adhesion of the sprayed layer. An additional heating of the support before coating has the same effect. This can be carried out without danger of oxidation because the coating process is carried out practically in the absence of reactive gases. At the same time internal stresses in the spray layer can be reduced or even avoided by deliberate temperature alterations during the coating.

The above advantages of the VSP method have not been recognized or used up to now in the case of $Cr_2O_3$ protective layers. The main reason for this is that the danger of loss of oxygen is considerably increased and therefore an even greater chromium oxide reduction is to be expected because of the reduction of pressure in the plasma flame, the increased flame energy, the absence of oxygen from the air and because of the reducing atmosphere of the $Ar/H_2$-plasma flame.

The object of the invention is to produce a $Cr_2O_3$ protective layer as described in the first paragraph which does not contain the said metallic chromium inclusions, is sprayed as densely as possible or in the case of particular applications has a deliberatly set residual porosity, and which in both these cases has a very high hardness of the layer due to the almost chemical purity.

The measured hardness according to the Vickers-method should be over 2000 kp/mm$^2$ (HV) which can be compared with the hardness from ASP protective layers which usually have a value between 750 and 1200 kp/mm$^2$ (HV) depending on the amount of included metal phase. Further, the electrical insulation effect of the $Cr_2O_3$ protective layer should considerably exceed that of ASP chromium oxide protective layers. The electrical breakdown strength, measured in volt/layer thickness can be used as an indirect measure of the quantity of included metal phase and therefore also for the corrosion stability. The voltage withstand level of a ASP coated $Cr_2O_3$ protective layer does not exceed the value of 1 V/$\mu$m of layer thickness. The requirement is at least 5 V/$\mu$m of layer thickness.

The object of the invention is solved in that the $Cr_2O_3$ protective layer is applied to the support by the vacuum plasma spray process with a density almost corresponding to the density of chromium oxide as a solid substance, with a residual porosity considerably below 2% and a Vickers hardness of more than 2000 kp/mm$^2$ (HV).

Unexpectedly, the sprayed $Cr_2O_3$ protective layer produced with the help of the VSP method has almost no metallic phase although the pressure in the plasma flame compared with the atmospheric plasma spray method is considerably reduced, the energy of the plasma flame is increased, no oxygen is available and the spraying is carried out with a reducing plasma mixture.

Advantageously, the porosity of the $Cr_2O_3$ protective layer is not more than 2%. The specific density is not more than 5.3 g/cm$^3$ and the Vickers hardness is at least 2150 kp/cm$^2$ (HV).

The electrical voltage withstand of the $Cr_2O_3$ protective layer is advantageously less than 5 V/μm of the layer thickness.

It is useful if the surface of the support is lightly sand blasted, cleaned by sputtering and degased by warming using the electric arc before the coating of the $Cr_2O_3$ protective layer.

For particular applications, it can be advantageous to spray on an underlayer before the application of the $Cr_2O_3$ protective layer.

Alternatively, a $TiO_2$ protective layer can be applied instead of a $Cr_2O_3$ protective layer.

According to the invention, a process for the manufacture of a $Cr_2O_3$ protective layer is characterized in that the $Cr_2O_3$ protective layer is applied by the vacuum plasma spray process at a pressure of about 150 mbar and with a spraying distance of about 240 mm, the plasma current being about 720 A, the flame power being about 57 KW and the spray powder rate being about 30 g/min, while the throughput of plasma gas is about 30 l/min of argon and about 10 l/min of hydrogen.

It is useful that the support for the $Cr_2O_3$ protective layer is only lightly sand blasted before the direct application.

Further, it is an advantage if the support of the $Cr_2O_3$ protective layer is degased and sputter cleaned by the transferred electrical arc immediately before the application.

In the following, the invention is explained on hand from an example and the drawing. In the drawing is shown FIG. 1 the layer structure in cross-section of a sprayed $Cr_2O_3$ protective layer according to the ASP-method FIG. 2 the layer structure in cross-section of a sprayed $Cr_2O_3$ protective layer according to the VSP-method of the present invention.

A support 1 is shown schematically in FIG. 1 which was roughened by sand blasting in the ASP coating method. The surface 2 of the support 1 includes a certain minimum roughness by which the $Cr_2O_3$ protective layer 3 is keyed in mechanically to the surface of the support. The measured adhesive forces of the $Cr_2O_3$ protective layer 3 on the support material treated as above is about 25 MPa.

Depending on the plasma parameter settings $Cr_2O_3$ protective layers are produced with a porosity of over 10%. This can be recognized in the structure of the sprayed layer as micro-porosity 4, which is spread evenly over the $Cr_2O_3$ protective layer 3. Also dependent on the plasma spray parameters is the number of included chromium phases 5 which are shown as thin filaments in the sprayed layer structure. They are responsible for the reduction in the layer hardness which varies between 750 and 1200 kp/mm$^2$ (HV).

In the polished section given in FIG. 1, it is not only possible to see the areas which have been completely reduced to chromium. Also areas in which $Cr_2O_3$ has only been partly reduced, which are described by the formula $Cr_xO_y$ are to be seen in the polished section of the sprayed layer. The area appears darker when the oxygen loss is greater. This is measurable by the layer hardness measurement. The diameter of the impression 6 of the layer hardness measurement (a rectangle according to the Vickers-method in the present example) is a direct measurement of the layer hardness.

Figure 2:
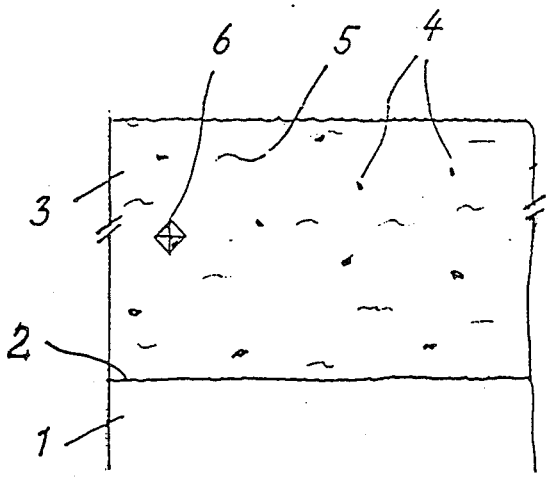

FIG. 2 shows schematically the layer structure of the $Cr_2O_3$ protective layer 3 applied according to the method of the invention in vacuum using optimized plasma parameters. The support 1 of the $Cr_2O_3$ protective layer is for example a drawn foil cylinder roll. Its surface 2 has been directly coated after a very light sand blasting, a sputter cleaning and degasing having been carried out by heating with the help of the transferred electric arc immediately before the coating process. The adhesion of the layer is provided by the additional keying from the neutralization of free surface energy of the cleaned, oxide free surface of the support given by the first sprayed on coating layer. The sprayed on $Cr_2O_3$ protective layer 3 according to the invention adheres to the as above prepared steel roll surface with about 65 MPa. Its specific density exceeds 5,3 g/cm$^3$ which is only a little below the theoretical value for pure $Cr_2O_3$. This can be seen from the almost complete absence of micro-porosoties 4.

The $Cr_2O_3$ protective layer 3 manufactured according to the invention, shows a as major difference practically no lines of differing gray shades which would demonstrate the inclusion of metallic chromium phases 5 and the areas of oxygen loss in the $Cr_2O_3$ protective layer. This is also shown by the impression 6 of the layer hardness measurement which is 2150 kp/mm$^2$ (HV) for this layer structure. The required chemical resistance is also present which indirectly is indicated by the improved breakdown strength which is at least 5 V/μm of layer thickness.

The properties of the $Cr_2O_3$ protective layer 3 according to the invention are obtained for a commercially available vacuum plasma burner with the most important plasma spray parameters given in the accompanying table, the values for ASP-layers being given as a comparison:

| VSP | ASP | ASP | |
|---|---|---|---|
| Ambient pressure | mbar | 140 | 1000 |
| Spraying distance | mm | 240 | 110 |
| Plasma current | A | 720 | 700 |
| Flame power | kW | 57 | 50 |
| Plasma gas 1 (Ar) | l/min | 30 | 60 |
| Plasma gas 2 ($H_2$) | l/min | 10 | 12 |
| Spray Powder rate | g/min | 30 | 40 |

A physical explanation for the surprising properties of the vacuum spray $Cr_2O_3$ protective layer 3 can probably be found in the 2 to 3 times higher process speed of the vacuum plasma spraying process. The dwell time of the $Cr_2O_3$ particles above the required critical process temperature for the liberation of oxygen, is reduced considerably. Similar improvements in the properties of the layers sprayed on using the VSP method can be demonstrated with other materials subject to decomposition. Similar methods according to the invention for producing hard practically chemically pure $Cr_2O_3$ spray layers can be transferred without restriction to all materials subject to decomposition in order to convert them into a spray layer with the least possible chemical alteration. This is on the other hand not so striking with for example $TiO_2$.

I claim:

1. An article comprising, in combination, a protective layer of $Cr_2O_3$ on a metal support applied by a vacuum plasma spray process, said support having a surface pre-treated by a transferred electric arc immediately prior to the application of said protective layer and wherein the $Cr_2O_3$ is conveyed in said spray process in a plasma flame having a reducing atmosphere, said protective layer having a density almost corresponding to the density of chromium oxide as a solid material, a residual porosity of less than 2%, a Vickers hardness of more than 2000 kp/mm$^2$ (HV), and being substantially free of imbedded metallic phases.

2. Protective layer according to claim 1, wherein the porosity of the $Cr_2O_3$ protective layer is less than 2%, its specific density is not more than 5.3 g/cm$^3$, and its Vickers hardness is more than 2150 kp/mm$^2$ (HV).

3. Protective layer according to claim 1, wherein the electrical breakdown strength of the $Cr_2O_3$ protective layer is at least 5 volt/$\mu$m of the layer thickness.

4. Protective layer according to claim 1, wherein the surface of the support is lightly sand blasted, sputter cleaned and degased by heating from the electric arc.

5. An article comprising in combination a protective layer of $TiO_2$ on a metal support applied by a vacuum plasma spray process, said support having a surface pre-treated by a transferred electric arc immediately prior to the application of said protective layer and wherein the $TiO_2$ is conveyed in said spray process in a plasma flame having a reducing atmosphere, said protective layer having a density almost corresponding to the density of titanium oxide as a solid material, a residual porosity of less than 2%, a Vickers hardness of more than 2000 kp/mm$^2$ (HV), and being substantially free of imbedded metallic phases.

6. Process for the manufacture of a $Cr_2O_3$ protective layer wherein the $Cr_2O_3$ protective layer has a density almost corresponding to the density of chromium oxide as a solid material, a residual porosity of less than 2%, a Vickers hardness of more than 2000 kp/mm$^2$ (HV) and being substantially free of imbedded metallic phases, comprising spraying the $Cr_2O_3$ protective layer by a vacuum plasma spraying process at a pressure of about 140 mbar and a spraying distance of about 240 mm, the plasma current being about 720A, the flame power being about 57 KW and the spray powder rate being about 30 g/min., while the throughput of the plasma gas is about 30 l/min. argon and about 10 l/min. hydrogen.

7. Process according to claim 6, wherein the support of the $Cr_2O_3$ protective layer is only lightly sand blasted before direct application of said $Cr_2O_3$ protection layer.

8. Process according to claim 6 or 7, wherein the support of the $Cr_2O_3$ protective layer is sputter cleaned and degased by heating by the transferred electrical arc.

* * * * *